US008453799B2

(12) United States Patent
Müller et al.

(10) Patent No.: US 8,453,799 B2
(45) Date of Patent: Jun. 4, 2013

(54) ACTUATOR FOR A SPEED GOVERNOR OF AN ELEVATOR SYSTEM

(75) Inventors: Jochen Müller, Filderstadt (DE); Christian Schulz, Stuttgart (DE)

(73) Assignee: Thyssenkrupp Elevator AG, Essen (DE)

( * ) Notice: Subject to any disclaimer, the term of this patent is extended or adjusted under 35 U.S.C. 154(b) by 0 days.

(21) Appl. No.: 13/468,762

(22) Filed: May 10, 2012

(65) Prior Publication Data

US 2012/0312638 A1 Dec. 13, 2012

Related U.S. Application Data

(63) Continuation of application No. PCT/EP2010/066547, filed on Oct. 29, 2010.

(51) Int. Cl.
*B66B 5/06* (2006.01)

(52) U.S. Cl.
USPC ..... 187/287; 187/393

(58) Field of Classification Search
USPC ..... 187/250, 254, 262, 264, 266, 277, 187/286–288, 305, 350, 391–393, 414; 192/105 C–105 CF, 103 A, 103 C, 103 R, 200, 201, 192/209, 210
See application file for complete search history.

(56) References Cited

U.S. PATENT DOCUMENTS

| | | | | |
|---|---|---|---|---|
| 4,134,482 | A * | 1/1979 | Polyak et al. | 192/85.15 |
| 5,492,200 | A | 2/1996 | Krochnen | |
| 8,336,677 | B2 * | 12/2012 | Kigawa et al. | 187/391 |
| 2006/0003866 | A1 * | 1/2006 | Unno et al. | 477/44 |
| 2008/0149431 | A1 * | 6/2008 | Vantanen | 187/287 |
| 2009/0314586 | A1 * | 12/2009 | Okada | 187/287 |
| 2010/0059319 | A1 * | 3/2010 | Aguado et al. | 187/414 |
| 2011/0127116 | A1 * | 6/2011 | Niikawa | 187/350 |
| 2011/0272217 | A1 * | 11/2011 | Niikawa | 187/305 |
| 2012/0199422 | A1 * | 8/2012 | Okada | 187/393 |
| 2013/0001020 | A1 * | 1/2013 | Kigawa et al. | 187/254 |

FOREIGN PATENT DOCUMENTS

| | | | |
|---|---|---|---|
| DE | 1800270 | A | 5/1969 |
| DE | 102007052280 | A1 | 5/2009 |

OTHER PUBLICATIONS

Machine Translation of DE 1800270A1, Aufzuge AG Schaffhausen, May 22, 1969, 4 pages.
European Application No. 09175529.8, Search Report and Opinion dated Mar. 11, 2010, 6 pages.
European Application No. 09175529.8, Decision to Grant a European Patent dated Nov. 28, 2012 (and English translation of the claims), 5 pages.

* cited by examiner

*Primary Examiner* — Anthony Salata
(74) *Attorney, Agent, or Firm* — Lathrop & Gage LLP

(57) ABSTRACT

An actuator for a speed governor of an elevator system includes a governor wheel equipped with at least two flyweights. The governor wheel can be driven by a governor cable looped around it. An actuator wheel is stationary in a basic position. A coupler engages the actuator wheel when the governor wheel attains an actuation speed and thus couples with the governor wheel so that the actuator wheel is caused to rotate. An elastic material, preferably transmitting a high degree of friction, is provided between the coupler and the actuator wheel. The actuator wheel has a lining or tire of the elastic material and/or the coupler is equipped with the elastic material.

13 Claims, 3 Drawing Sheets

ACTUATOR FOR A SPEED GOVERNOR OF AN ELEVATOR SYSTEM

CROSS REFERENCE TO RELATED APPLICATIONS

This application is a continuation of international application number PCT/EP2010/066547, filed in the European Patent Office on Oct. 29, 2010, designating the United States of America, which claims priority to European Patent Application 09175529.8, file Nov. 10, 2009, the entire contents of which are incorporated herein by reference.

BACKGROUND

1. Field of the Invention

The present invention relates to an actuator for a speed governor of an elevator system, and also to a speed governor equipped with such an actuator.

2. Description of Related Art

Speed governors for elevator systems initiate emergency measures, for example the activation of a safety stop device, if an actuation speed is exceeded.

DE 34 46 337 A1 discloses a speed governor for an elevator system that actuates the safety stop of the elevator cabin if the actuation speed is exceeded. The speed governor comprises a cable sheave that is connected to the elevator cabin by means of a cable loop and is set in rotation when the elevator cabin moves. The cable sheave carries flyweights that are connected to rotatably mounted eccentric cams. When the cable sheave rotates the flyweights swing outwards, the eccentric cams thereby being rotated or deflected so that they press against a brake wheel if the actuation speed is exceeded. In this way the cable sheave and, as a result of the traction of its cable groove, the cable looped around it are braked, the safety stop device thereby being actuated.

In addition, speed governors are known in which, instead of a brake wheel, an actuator wheel is provided, which, when the actuation speed is exceeded, is engaged by the coupling means and caused to co-rotate. Due to the rotation of the actuator wheel a cable brake for the cable looped around the cable sheave is then actuated, whereby in turn a safety stop device on the elevator cabin is actuated. Such a speed governor is marketed for example under the reference number OL100 by the Wittur company.

The speed governors known in the prior art have the disadvantage that the cooperation of cable sheave, flyweights, coupling means and actuator and brake wheel involves a large number of individual components, which are all subject to specific tolerance requirements. The previous solutions require high manufacturing tolerances, since they are structurally over-determined and have a degree of redundancy. This redundancy of the construction can lead to malfunctions and a high degree of wear. The overall system is consequently relatively expensive, since in the production certain minimum tolerances for the individual components have to be maintained. This also arises from the symmetrical construction, i.e., individual components such as for example flyweights and coupling means are as a rule provided at least in duplicate, so that the tolerances of an individual component as well as tolerances involving several components play a role. As a result, in particular, the production and maintenance proves to be difficult since not only structural components have to be found that lie within the prescribed tolerance limits, but their dimensions also have to be matched to one another. Since an elevator is normally subjected to large forces and speeds, the individual components have to be manufactured from rigid and solid materials, such as for example steel, that have a very high spring constant, so that the permissible tolerances are relatively small. Owing to the large spring constants large forces act, this means that the components, bearings and bolts have to be robustly designed.

It is therefore desirable to provide an actuator for a speed governor that is simpler and therefore less expensive to produce, in which the actuation behaviour must not however be adversely affected.

SUMMARY

According to one aspect, an actuator for a speed governor of an elevator system is provided. The actuator includes a governor wheel equipped with at least two flyweights, which governor wheel can be driven by a governor cable looped around it. An actuator wheel is stationary in a basic position. A coupler engages the actuator wheel when the governor wheel attains an actuation speed and thus couples with the governor wheel so that the actuator wheel is caused to rotate. An elastic material, preferably transmitting a high degree of friction, is provided between the coupler and the actuator wheel. The actuator wheel has a lining or tyre of the elastic material and/or the coupler is equipped with the elastic material.

Further advantages and modifications of the invention follow from the detailed description and the accompanying drawings.

BRIEF DESCRIPTION OF THE DRAWINGS

The foregoing and other features and advantages of the invention will be apparent from the more particular description of preferred aspects of the invention, as illustrated in the accompanying drawings in which like reference characters refer to the same parts throughout the different views. The drawings are not necessarily to scale, emphasis instead being placed upon illustrating the principles of the invention.

Figure 1:
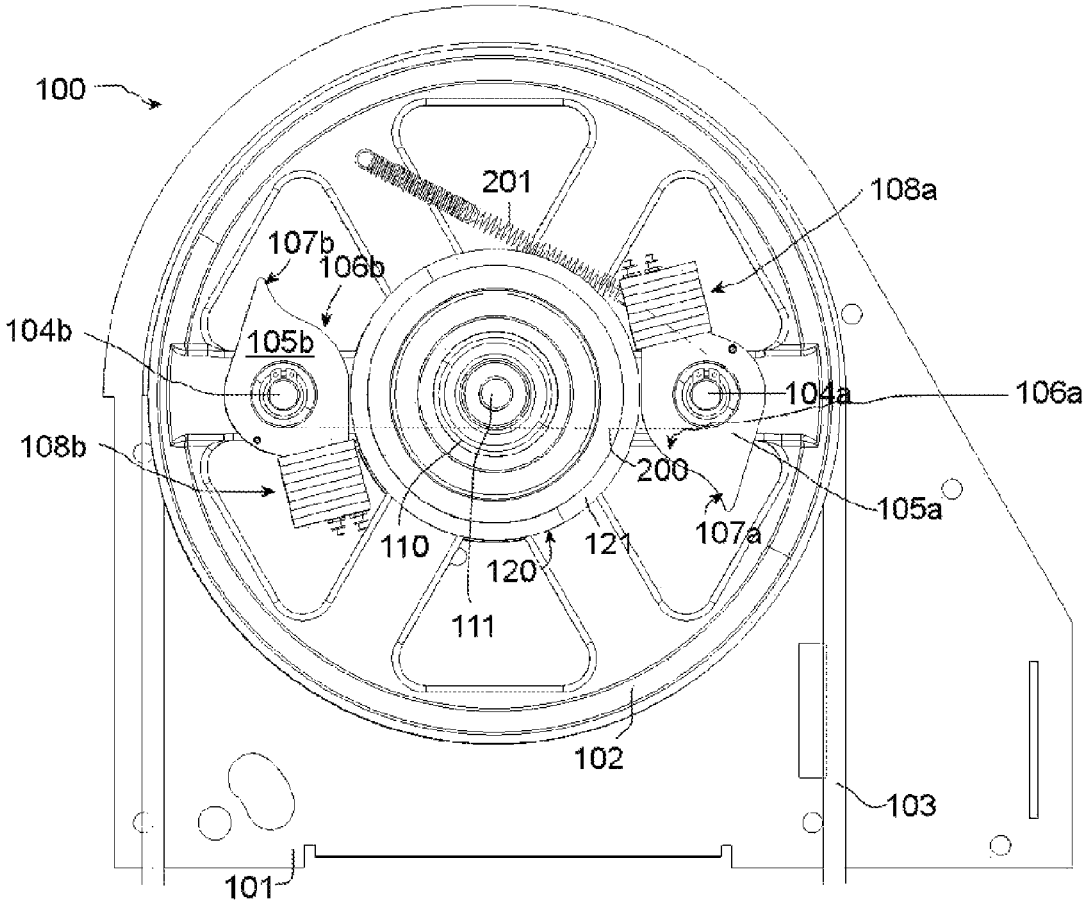
FIG. 1 contains a schematic plan view of an actuator, according to some embodiments.

The disclosure teaches that an elastic material is provided between the coupler or coupling means and the actuator wheel. Due to the elasticity, size variations between structural components and also tolerance excesses can be compensated. As a result, the tolerance requirements on the individual structural components are less stringent, so that the production costs can be reduced.

Also, the high rigidity of the clamping mechanism occurring in the prior art, which leads to large normal forces and also narrow tolerance ranges, is reduced. The actuator wheel can be divided over its width into two functional regions, namely a clamping region, which comes into contact with the coupling means, and an actuation region, against which the actuator lever abuts. A, elastic, e.g., rubber, material is now provided, in particular as a lining, at least in the clamping region. In this way the rigidity is reduced and also the static friction is increased, whereby already smaller normal forces are sufficient for the actuation. At the same time the material forms a spring component, which becomes softer with increasing thickness of the lining.

In some embodiments, the material has a high static friction in contact with the coupling means as well as a high elastic deformability. At the same time the shear strength and the quality of the connection to the base body should be sufficient to transmit the actuation moment. In addition, the arrangement should have high fatigue strength also under the prevailing environmental influences. Due to the rubber-like properties, a damping effect is additionally produced during actuation, which contributes to the preservation of the material especially at high speeds.

If an elastic material is used that at the same time has a friction-mediating action, the response behaviour can be improved and the reliability of the response can be increased. The elasticity as well as the friction of the material can be chosen so that a rotation of the actuator wheel reliably occurs as soon as a predetermined engagement of the actuator wheel by the coupling means occurs. The ratio of elasticity to friction can be predetermined so as to ensure a tolerance compensation of structural component sizes and a reliable actuation of the actuator wheel. The actuator wheel can in turn actuate an actuator lever to actuate a cable brake and/or a switch for disconnecting the elevator drive from the power supply.

It was recognised that, contrary to expectation, elastic material can intentionally also be used in elevator construction, where severe environmental conditions exist in the elevator shaft and large forces act, so as to achieve specific advantages. For example Vulcollan can be used as elastic material with suitable properties. Other elastomer-based plastics can likewise be used.

The actuator wheel advantageously comprises a tyre or lining of the elastic material. In this way the material can readily be provided between the actuator wheel and coupling means and can also be replaced, for example in the case of wear and tear. Alternatively or in addition, the coupling means can also be equipped with the elastic material.

According to some embodiments, the flyweights form at the same time the coupler or coupling means. In this preferred solution at least two additional structural components as well as their connection means can thereby be dispensed with. The construction of the actuator is simpler and less expensive. The construction is kinematically and statically specified, which increases the tolerance ranges that have to be observed. The coupling means acting as flyweights (or the flyweights acting as coupling means) conveniently comprise a coupling region for engaging and contacting the actuator wheel, and also a weight region. The weight region is advantageously formed so that it does not come into contact with the actuator wheel and is suitable for accommodating separate additional weights. These separate additional weights serve to adjust the actuation speed of the actuator.

If the edge of the coupling means has at least in part the shape of an Archimedian screw, then a gentle engagement of the actuator wheel occurs without sudden jolting with a moderate increase in force. The correspondingly shaped edge of the coupling means advantageously lies in the region identified above as the coupling region. In particular, in this modification the provision of an elastic material can bring particular advantages, since the coupling means acting as flyweights can if necessary have different shapes depending on the actuation speed, so that the distance of the edge of the coupling means from the actuator wheel possibly depends on the design of the speed governor. These different distances can be compensated by the elastic material, with the retention of all the other structural quantities.

If the coupler or coupling means comprises a lug that defines an end stop means, then an excessive engagement of the actuator wheel by the coupling means can be avoided. At the start of the actuation procedure the actuator wheel is at rest. The coupling means rotate around the actuator wheel at the speed of the governor wheel however and are thereby—depending on the rotational speed of the governor wheel—deflected about their own axis. The coupling means are in this connection conveniently arranged so that the rotation and deflection about their axis on engagement of the actuator wheel leads to a self-reinforcement of the engagement. This self-reinforcement continues until the actuator wheel has attained the rotational speed of the governor wheel. In order however not to risk any excessive rotation of the coupling means, these are advantageously fitted with an end stop. When this stop means engages the actuator wheel no further co-rotation can occur.

In some embodiments, the flyweights are coupled to one another by means of a cable connection and are spring-loaded under tension, so that a linear relationship exists between the spring loading and the deflection of the flyweights. The flyweights are arranged in pairs on the governor wheel and are connected by means of a cable connection, in order to compensate gravity effects. Furthermore they are pretensioned (biased) against the centrifugal force action, so that a deflection of the flyweights sufficient to engage the actuator wheel takes place only when the actuation speed is reached. In this connection the flyweights and the spring are advantageously dimensioned so that no deflection of the flyweights occurs below the actuation speed. In this way the aforementioned structural components remain at rest during normal operation, so that there is no wear. Due to the spring-loaded cable connection a linear connection can be provided between the spring loading and the deflection of the flyweights can exist, so that the desired actuation speed can be adjusted in a very simple way.

In some embodiments, the flyweights are arranged on the governor wheel so that the distance between the centre of gravity of each of the flyweights and the rotation axis of the governor wheel is shorter than the distance between the rotation axis of the flyweights and the rotation axis of the governor wheel. That is, the centre of gravity of each flyweight is closer to the rotation axis of the governor wheel than its own rotation axis. This arrangement means that the speed of response of the governor depends on the rotational acceleration of the rotation wheel insofar as an acceleration of the governor wheel leads to a more rapid response of the actuator. This behaviour is particularly advantageous especially in case of cable breakage, since a large downwards acceleration of the elevator cabin then occurs and as quick an actuation as possible is desirable.

If the governor wheel is provided with a central co-rotating shaft, this can for example serve as installation site for other units. In particular rotary encoders, among other items, can thereby easily be installed in an elevator system.

A speed governor according to the invention for an elevator is equipped with an actuator according to the disclosure for engaging a cable brake and/or for actuating a switch to stop an elevator drive.

A cable brake according to some embodiments comprises a four-component coupling linkage mechanism, in particular a thrust crank. A large lever action can be generated in this way, so that a large braking force, which can be provided for example by a tensioned spring, can be held by a small actuation force. This small actuation force is absorbed by the actuator wheel.

In some embodiments, the cable brake includes an eccentric thrust crank, in which in particular the eccentricity is larger than the crank length.

In this connection, the linkage joining the crank and the connecting rod presses via an actuator lever against the actuator wheel. The actuator lever is held in a metastable state on the actuator wheel. The linkage is thereby engaged so that the cable brake is released. If the actuator is released the actuator wheel is set in rotation and thereby forces the actuator lever away. The linkage can thus move, so that the connecting rod can retract and stop the cable brake.

In order to save space the cable brake can be pretensioned by means of at least one disc spring. For the simple release of the cable brake a screw arrangement can be provided, in which for example by means of a screw-in bolt or nut a transmission element located therebehind, such as for example an abutment disc, clamps or tensions the spring (disc spring, spiral spring, etc.), In some embodiments, the governor wheel can be loaded on both sides. Flyweights with an actuator wheel for actuating the cable brake are located on one side, while flyweights and an actuator wheel for actuating an electric switch are arranged on the other side. Different actuation speeds for the cable brake and the electric switch can be made available and adjusted thanks to the bilateral arrangement. In particular the parameters "Actuation speed" (mechanical emergency stop) and "Prestop speed" (electrical emergency stop) required by current norms governing elevators can be adjusted independently of one another.

It is understood that the aforementioned features and the features still to be described hereinafter can be used not only in the combination given in each case, but also in other combinations or individually, without going beyond the scope of the present invention.

Figure 2:
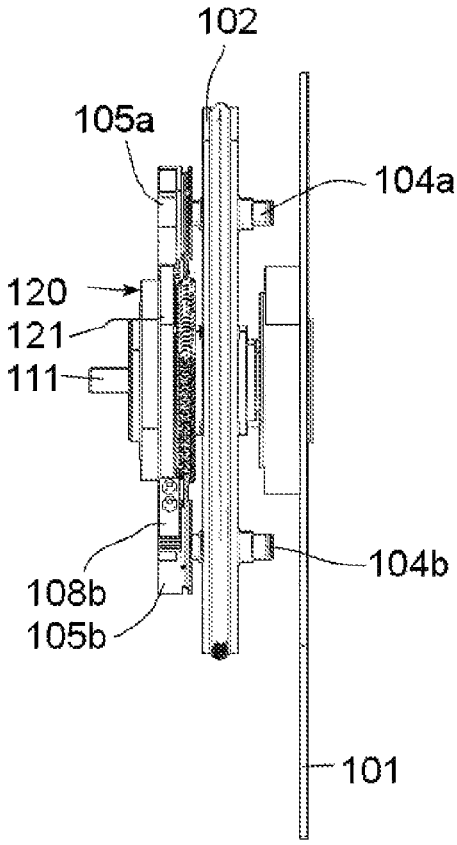
FIG. 2 contains a schematic side view of the actuator of FIG. 1, according to some embodiments.
Figure 3:
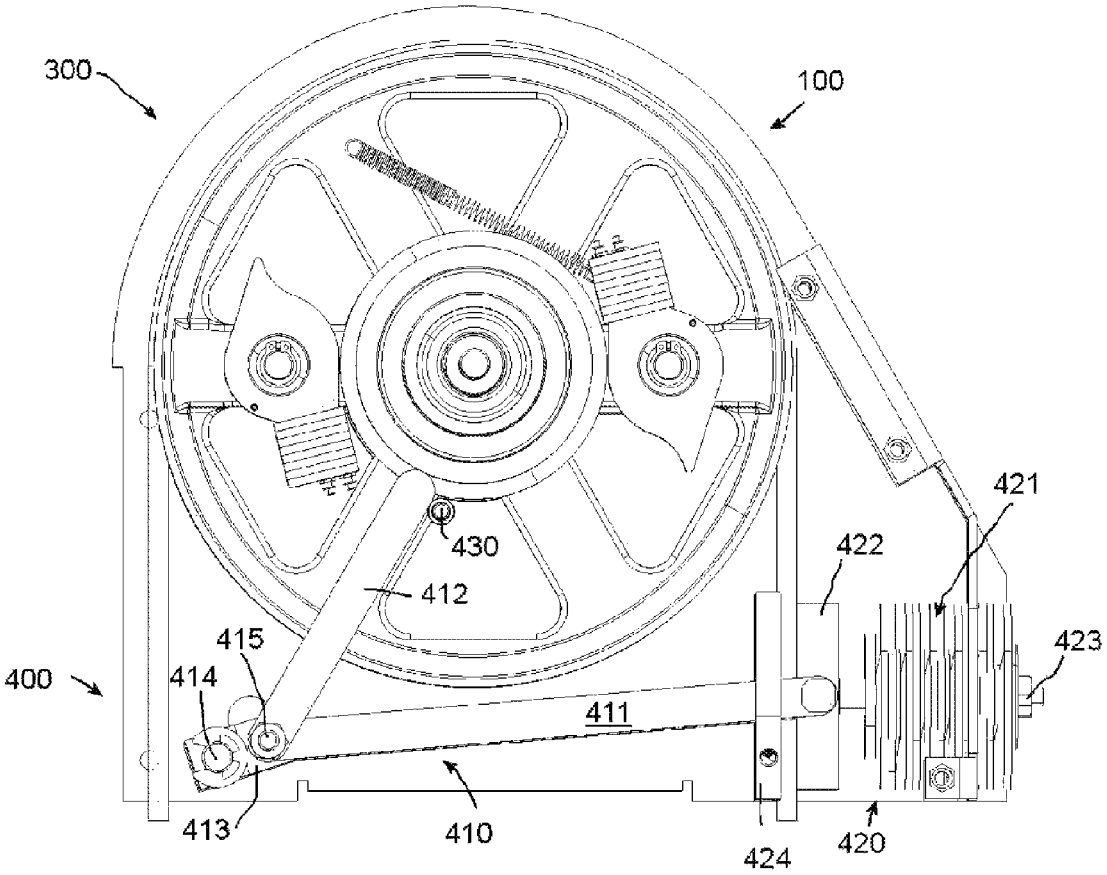
FIG. 3 contains a schematic plan view of a speed governor with an actuator and a cable brake, according to some embodiments.

In FIGS. 1 to 3 identical elements are provided with the same reference numerals. FIGS. 1 and 2 are in this connection described collectively and as a whole. Components of a preferred embodiment of an actuator 100 according to the disclosure are schematically illustrated in plan view in FIG. 1 and in a side view in FIG. 2.

The actuator 100 comprises a support 101, on which in particular the elements to be actuated, such as for example a cable brake or an electric switch, can also be installed. A governor wheel 102 is rotatably mounted on the support 101, and is set in rotation by a governor cable 103 during operation. The governor wheel 102 is rotatably mounted on a bearing 110. The governor wheel 102 comprises two flyweights 105*a*, 105*b* rotatably mounted on axes 104*a*, 104*b*, the flyweights acting at the same time as the coupler or coupling means.

In the illustrated basic position the flyweights are not deflected and do not engage the actuator wheel. The flyweights 105*a*, 105*b* have in each case a coupling region 106*a*, 106*b* as well as a lug 107*a*, 107*b* defining a stop means. In addition the flyweights 105*a*, 105*b* comprise mountable and removable additional weights 108*a*, 108*b* in order to adjust or pre-set the actuation speed of the actuator 100.

The flyweights/coupling means (coupler) 105*a*, 105*b* are connected by means of a cable pull connection 200, which is pretensioned (biased) by a spring 201. Thus, a predetermined centrifugal force must be attained in order to overcome the spring pretensioning (biasing) force. The spring pretensioning force is conveniently pre-set so that the flyweights/coupling means (coupler) 105*a*, 105*b* remain at rest during normal operation and are not deflected. Wear and also interfering noise, in particular rattling, can thereby be avoided. The cable connection 200 serves in particular for gravity compensation.

The governor wheel 102 is connected in a torque-resistant manner to a central shaft 111 that rotates synchronously with the governor wheel and can be used for example to accommodate a rotary encoder. Thus, the rotational speed of the governor wheel can for example be electronically scanned in a simple manner.

An actuator wheel 120 is furthermore rotatably mounted on the bearing 110, the wheel being at rest during operation in the non-actuated state. The actuator wheel 120 comprises a ring 121 of elastic material, which serves in particular to compensate tolerances and also to transmit friction.

In the illustrated, non-actuated state (basic position) the flyweights/coupling means (coupler) 105*a*, 105*b* are not deflected and are therefore not in contact with the actuator wheel 120. If however the rotational speed of the governor wheel 102 exceeds the predetermined actuation speed, the flywheels/coupling means 105*a*, 105*b* are deflected against the force of the spring 201 and approach the actuator wheel until they contact it. Depending on the distance, a swivel angle of up to 30° is used for this. Finally the coupling regions 106*a*, 106*b* come in to contact with the elastic material 121 of the actuator wheel 120. The flyweights/coupling means (coupler) 105*a*, 105*b* then independently continue to roll further due to the static friction, until the actuation moment is attained. In this way the rotational movement of the governor wheel 102 is transferred to the actuator wheel 120, which as a result is caused to execute rotational movement. Starting from a swivel angle of about 70°, a further rolling is prevented by the impact with the specially shaped lugs. Due to this limitation on the maximum swivel angle the flyweights/coupling means are prevented from moving any further and at the same time the system is protected against overload. The impact of the lug 107*a* and 107*b* formed on each flyweight/coupling means (coupler) on the actuator wheel 120 produces a significant displacement of the force impact point. As a result the ratio of the normal force to the static friction force necessary for further rolling changes to such an extent that slipping occurs. The system is designed so that the actuation moment at this point is already reliably exceeded. The further increase of the moment due to the inertia of the actuator wheel 120 is already greatly reduced due to the damping action of the elastic lining 121 and is limited upwardly by the sliding.

A rotational movement of the actuator wheel 120 can in turn be used to initiate different functions, for example an electric switch or a cable brake, as is described in detail hereinafter with reference to FIG. 3.

FIG. 3 shows a plan view of a preferred embodiment of a speed governor 300 according to the present disclosure, which includes the actuator 100 and also a particularly preferred configuration 400 of a cable brake. The cable brake 400 comprises a four-membered coupling mechanism formed as a thrust crank 410, and a clamping brake 420 pretensioned (biased) by means of a disc spring arrangement 421. The clamping brake 420 includes a rigid brake jaw 424 as well as a movable brake jaw 422, which is held by a connecting rod 411 of the thrust crank 410 against the force of the disc spring 421.

An actuator lever 412 lies in a metastable position on a journal 430 as well as on the actuator wheel 120. The crank 413 is rotatably mounted on an axis 414 and is connected at a linkage 415 to the connecting rod 411 and the actuator lever 412. In the released position of the brake 400 the actuator lever 412 in the illustrated view forces the linkage 415 downwards, so that the connecting rod 411 forces the brake jaw 422 to the right.

If the actuator wheel 120 is however caused to rotate (in the clockwise direction) by engagement with the coupling means 105*a*, 105*b*, the actuator lever 412 in place on the actuator wheel is forced back to the left in the drawing, whereby the linkage 415 is released and can move upwards to the left. As a result the disc spring 421 forces the brake jaw 422 against the brake jaw 424 and clamps the cable 103 running therebetween.

In order to return a governor that has been actuated back to the basic position in a simple manner, the disc spring assembly 421 is provided with a thread arrangement 423, by the actuation of which the disc spring assembly 421 can be pretensioned (biased). In this way the force acting on the brake jaw 422 is released, so that the connecting rod 411 and the actuator lever 412 can be restored again to the illustrated position. For safety reasons it must then be ensured that the thread arrangement 423 is released again in order to pretension the brake jaw 422.

An actuator for a speed governor of an elevator system having a number of advantages can be provided according to the disclosure. The special construction provides a degree of robustness that allows conventional manufacturing tolerances without any disadvantageous effect. It is kinematically and statically determined and places fewer requirements on manufacturing accuracy. The processability is ensured. Smaller and lighter parts can be used, which simplifies production and reduces costs. Compared to known governors the device is small, light, has a long service life and generates only a small amount of noise.

We claim:

1. An actuator for a speed governor of an elevator system, comprising:

a governor wheel equipped with at least two flyweights, which governor wheel can be driven by a governor cable looped around it, an actuator wheel that is stationary in a basic position, a coupler that engage the actuator wheel when the governor wheel attains an actuation speed and thus couple with the governor wheel so that the actuator wheel is caused to rotate, wherein an elastic material, preferably transmitting a high degree of friction, is provided between the coupler and the actuator wheel, wherein the actuator wheel has a lining or tyre of the elastic material and/or the coupler are equipped with the elastic material.

2. An actuator according to claim 1, wherein the flyweights are simultaneously the coupling means.

3. An actuator according to claim 1, in which at least one coupling region of the edge of the coupler is in the shape of an Archimedian screw.

4. An actuator according to claim 1, wherein the coupler have in each case a lug that defines an end stop.

5. An actuator according to claim 1, wherein the flyweights are coupled to one another by means of a cable connection and are spring-loaded under tension so that there is a linear relationship between the spring loading and the deflection of the flyweights.

6. An actuator according to claim 5, wherein the flyweights and the spring are dimensioned so that no deflection of the flyweights occurs below the actuation speed.

7. An actuator according to claim 1, wherein the centre of gravity of a flyweight is at a shorter distance from the rotation axis of the governor wheel than the distance of the rotation axis of the flyweight from the rotation axis of the governor wheel.

8. An actuator according to claim 1, wherein the governor wheel is provided with a central, co-rotating shaft.

9. A speed governor for an elevator with an actuator according to claim 1 for actuating a cable brake and/or for actuating a switch for stopping an elevator drive.

10. A speed governor according to claim 9, wherein the cable brake comprises a four-membered coupling mechanism, in particular a thrust crank.

11. A speed governor according to claim 10, wherein the cable brake comprises an eccentric thrust crank, the eccentricity being in particular greater than the length of the crank.

12. A speed governor according to claim 10, wherein the linkage connecting the crank and the connecting rod presses via an actuator lever against the actuator wheel.

13. A speed governor according to claim 10, wherein the cable brake can be released by a thread arrangement.

* * * * *